US009433812B2

(12) United States Patent
Sillik

(10) Patent No.: US 9,433,812 B2
(45) **Date of Patent: *Sep. 6, 2016**

(54) SPORTS OR EXERCISE TRAINING DEVICE FOR HAND-SWUNG IMPLEMENTS

(71) Applicant: Francisco J. Sillik, Tucson, AZ (US)

(72) Inventor: Francisco J. Sillik, Tucson, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/817,130

(22) Filed: Aug. 3, 2015

(65) Prior Publication Data

US 2015/0335973 A1 Nov. 26, 2015

Related U.S. Application Data

(63) Continuation-in-part of application No. 14/329,590, filed on Jul. 11, 2014, which is a continuation-in-part of application No. 14/143,804, filed on Dec. 30, 2013, now Pat. No. 9,095,739.

(51) Int. Cl.

| | |
|---|---|
| ***A63B 69/00*** | (2006.01) |
| ***A63B 59/06*** | (2006.01) |
| ***A63B 15/00*** | (2006.01) |

(52) U.S. Cl.

CPC ..... *A63B 15/005* (2013.01); *A63B 59/50* (2015.10); *A63B 60/42* (2015.10); *A63B 69/0002* (2013.01); *A63B 60/50* (2015.10); *A63B 2069/0008* (2013.01); *A63B 2102/18* (2015.10); *A63B 2208/0204* (2013.01)

(58) Field of Classification Search

CPC ..... A63B 59/50–59/59; A63B 2102/18; A63B 60/04; A63B 15/005; A63B 2069/0002; A63B 2069/0008; A63B 60/24; A63B 2059/5812

USPC ..... 473/457, 519, 520, 564–568, 334–339

See application file for complete search history.

(56) References Cited

U.S. PATENT DOCUMENTS

| | | | | |
|---|---|---|---|---|
| 514,420 | A | 2/1894 | Jacobus | |
| 3,113,782 | A | 12/1963 | Guier | |
| 3,136,546 | A | 6/1964 | Connolly | |
| 3,137,504 | A * | 6/1964 | Zordan | A63B 24/0062 446/137 |
| 3,578,801 | A | 5/1971 | Piazza | |
| 4,274,631 | A | 6/1981 | Hayazaki | |
| 4,325,549 | A | 4/1982 | Vasselli | |
| 4,600,190 | A | 7/1986 | Berokoff | |
| 4,671,508 | A | 6/1987 | Tetreault | |
| 4,898,386 | A | 2/1990 | Anderson | |
| 4,900,038 | A | 2/1990 | Czetto et al. | |

(Continued)

FOREIGN PATENT DOCUMENTS

| | | |
|---|---|---|
| GB | 2222092 | 2/1990 |
| WO | 9314827 | 8/1993 |

*Primary Examiner* — Mark Graham

(74) *Attorney, Agent, or Firm* — Quarles & Brady LLP; Gavin J. Milczarek-Desai

(57) ABSTRACT

A hand-held sports or exercise training device configured to improve the swing of a user that includes a hollow body defining a interior volume extending within the device and a slidable mass having an passage that extends through the mass in the direction of movement, or, alternative, one or more passages that allow air flow are contained in a sleeve housing the slidable mass and/or in the bat end. The slidable mass is contained within the interior volume or an added sleeve and is in contact with an interior circumference of the hollow body or sleeve. As a user swings the device, the moment of inertia for the device changes such that swing mechanics and/or timing can be improved.

7 Claims, 6 Drawing Sheets

(56) References Cited

U.S. PATENT DOCUMENTS

| | | | | |
|---|---|---|---|---|
| 5,133,551 | A * | 7/1992 | Handy | A63B 59/50 473/567 |
| 5,590,875 | A | 1/1997 | Young | |
| 7,147,580 | B2 | 12/2006 | Nutter et al. | |
| 9,095,739 | B2 * | 8/2015 | Sillik | A63B 15/005 |
| 2014/0121042 | A1 | 5/2014 | Nutter | |
| 2014/0135154 | A1 | 5/2014 | Pegnatori | |
| 2014/0274493 | A1 | 9/2014 | Heussner | |

* cited by examiner

SPORTS OR EXERCISE TRAINING DEVICE FOR HAND-SWUNG IMPLEMENTS

CROSS REFERENCE TO RELATED APPLICATIONS

This application is a continuation-in-part application and claims the benefit of priority to U.S. application Ser. No. 14/329,590, entitled "Training Bat" filed on Jul. 11, 2014, which is a continuation-in-part and claims the benefit of priority to U.S. application Ser. No. 14/143,804, entitled "Training Bat" filed on Dec. 30, 2013, the entire contents of which are incorporated by reference.

BACKGROUND OF THE INVENTION

1. Field of the Invention

The invention relates generally to training devices for exercise, sports, etc., and more particularly to training implements that are swung with the hand, such as baseball/softball bats, racquets, golf clubs, and the like, designed to improve swing timing, power, and/or mechanics.

2. Description of the Related Art

Training bats, racquets, golf clubs, or the like with either a cylindrical or spherical stationary weight are well known. For instance, many a baseball training bat involves "donuts" or other weights which are used primarily to develop strength or to practice and perfect the swinging technique of the hitter. Such structures have included bats having unusual weight distribution as well as bats having removable or movable weights supported therein or thereon.

For example, U.S. Pat. No. 514,420 disclosed a bat in which an impact force multiplying device is provided. The impact device includes an elongated hollow passage defined within the striking end of the bat within which a plurality of weighted spherical balls are freely movable. A closure plug is threadably received at the striking end of the bat closing the passage and captivating the weighted balls within the passage. In an alternate embodiment, an elongated cylindrical sliding weight replaces the spherical balls. The intended function is provided by the change of bat characteristic during swinging as centrifugal force drives the weighted members outwardly from the passage end remote from the striking end to the striking end of the bat.

Another example includes U.S. Pat. No. 3,578,801, which sets forth a practice bat having an elongated hollow bat for baseball practice within which an elongated longitudinal rod is supported. A chamber extends along a portion of the elongated rod and supports a slidable weight thereon. During the swinging of the bat, the centrifugal force drives the weight outwardly toward the striking end of the bat.

While the foregoing devices are useful for their intended purposes, there remains a continuing need in the art for evermore improved practice and training devices.

SUMMARY OF THE INVENTION

The disclosure relates in general to practice device such as a bat, racquet, or club that has a hollow body defining a interior volume. The interior volume includes a slidable mass having a passage that extends through the mass in the direction of movement. Moreover, the slidable mass is contained within the device's interior volume and may be in contact with an interior circumference of the device or inside a sleeve within the device, thereby slidably engaged along the an interior circumference during a swinging motion.

The slidable mass means a changing (dynamic) moment of inertia (MOI). Therefore, embodiments may include a passage in the mass that has a different diameter at each end or within the passage, thereby providing a way to control the rate of change of the inertia (i.e., a control mechanism for dynamic MOI).

The moment of inertia changes as the mass moves further from the center of rotation. The following relationships describe this effect:

I=moment of inertia=the moment of inertia of the bat (I bat)+the product of the mass of slider times the square of the distance ($r^2$) from the center of rotation. Thus, I total=I bat+slider mass×$r^2$ where r increases.

Various other purposes and advantages of the invention will become clear from its description in the specification that follows. Therefore, to the accomplishment of the objectives described above, this invention includes the features hereinafter fully described in the detailed description of the preferred embodiments, and particularly pointed out in the claims. However, such description discloses only some of the various ways in which the invention may be practiced.

DETAILED DESCRIPTION OF THE PREFERRED EMBODIMENTS

Figure 2:
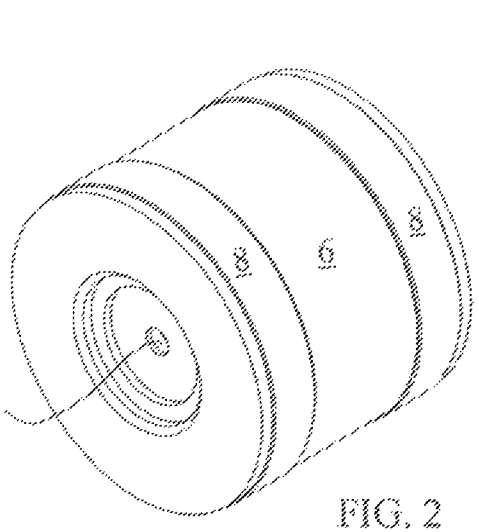
FIG. 2 depicts a back perspective view of the embodiment of a slidable mass for the inventive bat shown in FIG. 1.

Referring to FIGS. 1-4 and 6, a slidable mass 2 is shown having a passage 4 that extends through the mass in the direction of movement M. The slidable mass 2 is generally cylindrical (although ovoid and other shapes are possible) and may be made of metal such as steel or aluminum depending on the amount of weight desired. While not shown in the drawings, it should be understood that more than one mass 2 may be included or that "stackable" or "nesting" masses may be used in lieu of a single slidable mass, thereby giving the ability for both customizing both the amount of weight and the "feel" of the bat. A coating or lubricant may be used on the mass 2 and/or inner surface of the bat to aid in sliding.

The mass 2 further includes an outer surface 6 that preferably contains one or more seal(s) 8 to provide a smooth sliding motion. For example, a pair of seals disposed around a circumference of the mass 2 proximal to each end of the mass may be utilized. In the finished training bat, the seal(s) 8 are in contact with an interior circumference of the bat as shown FIGS. 6 and 7 and described in further detail below and may be made of a material allows for sliding movement, such as nylon or polytetrafluoroethylene, against the interior surface of the bat. While the seal(s) are shown to be anular in structure, any other configuration that allows sliding of the mass 2 while in contact with the inner circumference of the bat may be used.

Figure 4:
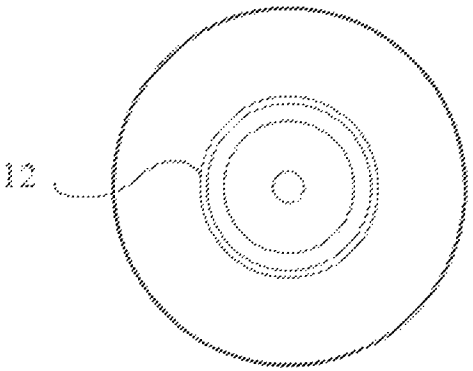
FIG. 4 depicts a back elevational view of the embodiment of the slidable mass shown in FIG. 2.
Figure 1:
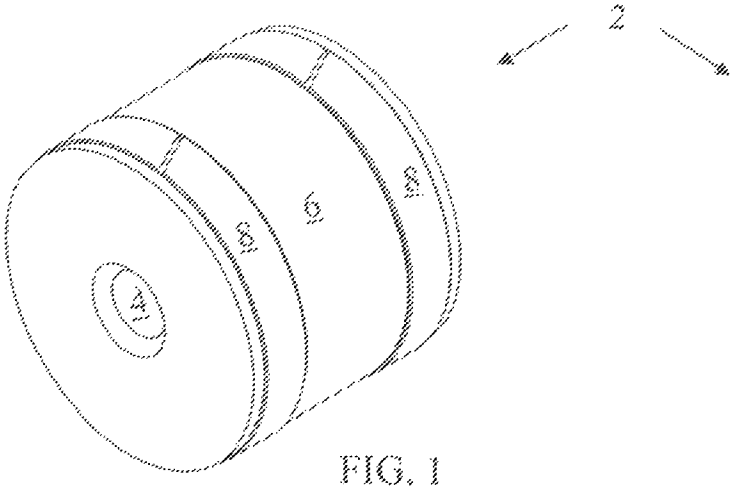
FIG. 1 depicts a front perspective view of an embodiment of a slidable mass for the inventive bat.
Figure 3:
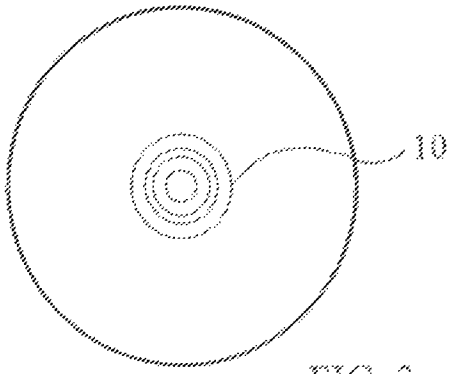
FIG. 3 depicts a front elevational view of the embodiment of the slidable mass shown in FIG. 1.

The passage 4 that extends through the slidable mass 2 preferably has a different diameter at each end of the mass, for example, diameter 10 and diameter 12 in FIGS. 3 and 4, respectively. The different diameter openings may extend a predetermined distance through the mass 2, as shown for example in FIG. 6, thereby causing the passage to have different diameters. By having different diameters for the passage, the speed of motion for the mass 2 is more precisely controllable, leading to different effects during a swing motion. For example, with the mass located close to the center of rotation at the start of a swing, the smaller inertia allows control and enhanced bat angular acceleration. Under a force due to centripetal acceleration, the mass slides outward. The orifice provides a method of controlling the rate at which the mass moves toward the end of the bat, with the purpose of optimizing the location of the sweet spot (center of percussion) at the time of bat and ball impact, and as the mass moves further outboard, providing increased inertia which aids in the training of swing follow through.

Figure 7:
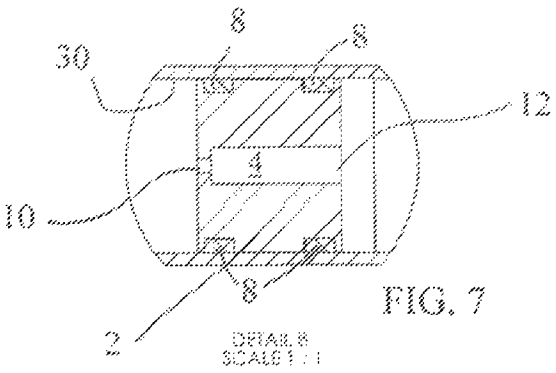
FIG. 7 depicts an enlarged cross-sectional view of the slidable mass in the embodiment shown in FIG. 6 and taken along the section defined by circle B.
Figure 6:
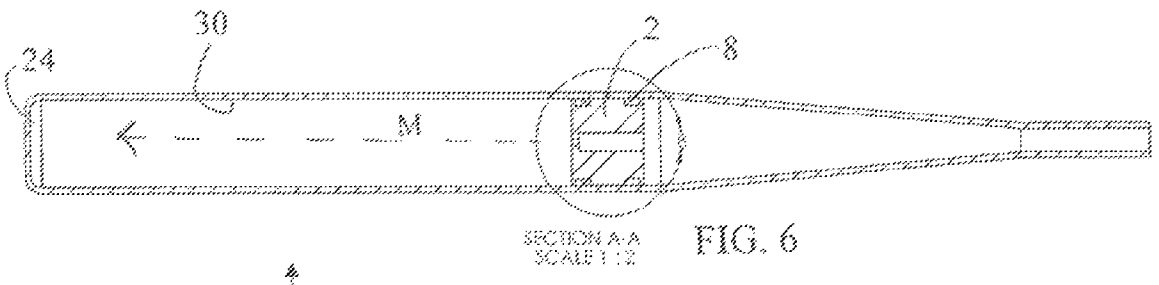
FIG. 6 depicts a cross-sectional view of the embodiment shown in FIG. 5 and taken along line A-A.
Figure 5:
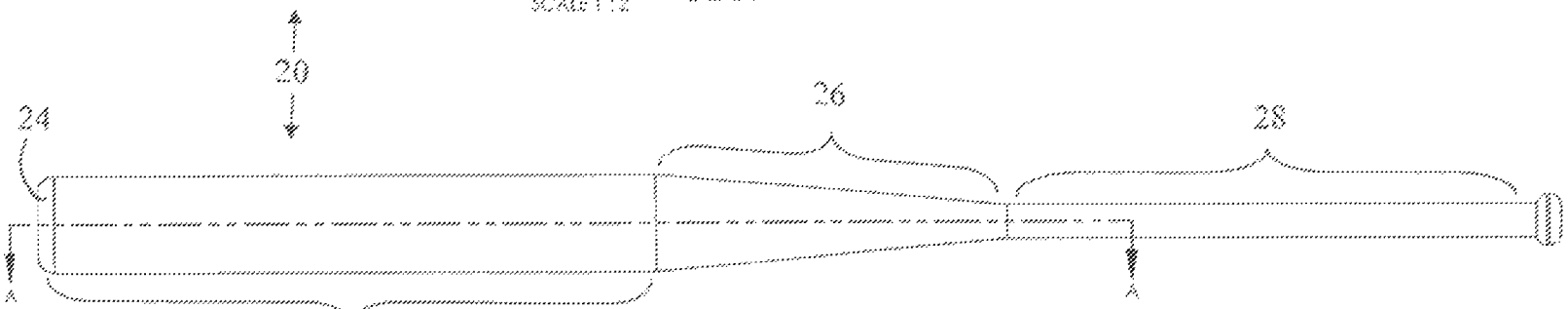
FIG. 5 depicts a side elevational view of an embodiment of an inventive bat.

Turning to FIGS. 5-7, an embodiment of an inventive bat 20 utilizing the sliding mass described above is shown. The bat includes a relatively thick barrel portion 22 topped by an end cap 24, which may act as a stop for the mass 2 and thus be made of rubber or a similar material, a junction or handle taper portion 26, and a handle portion 28. Different bat styles may be used, with or without an end cap, depending on desired characteristics and ability to change or alter the slidable mass 2.

The slidable mass shown in this embodiment is free from contact with any structure within the barrel portion 22 except for the interior circumference 30 upon which it slides and the end cap 24 (other embodiments may not have an end cap, however, in which case the mass contacts the end of the barrel portion 22). Hence, during a bat user's swing, the mass 2 will move M toward the bat end/end cap while air goes through the passage 4.

While not intending to limit this disclosure to any particular mechanism of action, the following explanation of the mechanics of the inventive bat is provided. The slidable mass 2 provides a dynamic Moment Of Inertia (MOI) with a reduced initial MOI prior to initiating a swing. In the action of swinging the bat, a centripetal acceleration acts on the bat causing a shift in position of the slidable mass, which increases the MOI as the swing progresses.

In other words, the reduced MOI at the beginning of the swing allows the batter to achieve a higher swing speed with more control up to the point of ball contact. With the increased MOI in the later part of the swing, the bat user is trained to follow through the swing after the ball/bat contact is completed.

Moment of inertia is a physical property which provides a measure of a body's resistance to a change in its angular rotation velocity. The determination of MOI is accomplished by defining a group of small individual mass particles, the sum of which equals the total mass, and defining the distance ($r_i$) of the mass particles ($m_i$) from a specified axis of rotation. The MOI can then be calculated as:

$$I_P = \sum_{i=1}^{N} m_i r_i^2.$$

Where N is the total number of discrete particles and subscript p is the point through with the axis of rotation passes Thus, the inventive bat works by the movement of the mass due to centripetal acceleration toward a closed volume of air in the end of the bat. The action of the moving slidable mass compresses the air into a smaller volume with higher pressure, causing the air to flow through an passage through the center of the mass. The passage restricts the flow providing a control mechanism for the rate of slider movement, and hence the change of MOI. Consequently, the swing dynamics can be customized for the strength and other attributes of different hitters.

Figure 8:
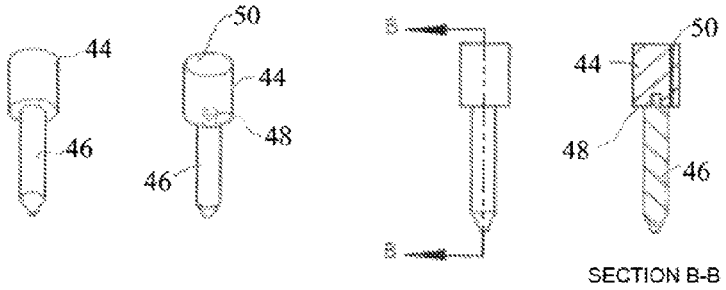
FIG. 8 depicts an alternative embodiment of a slidable mass.
Figure 9:
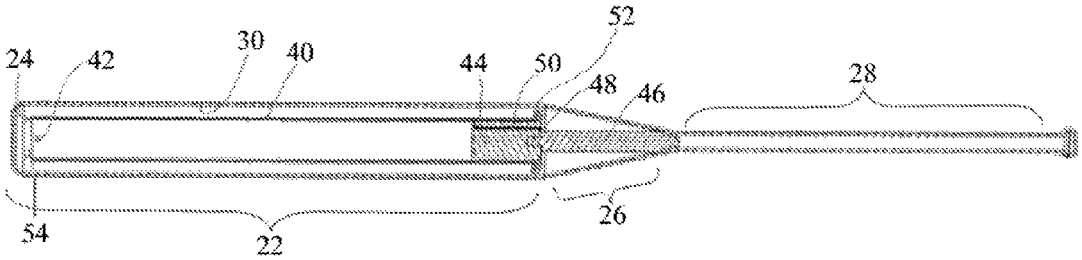
FIG. 9 depicts a cross-sectional view of a bat utilizing the slidable mass of FIG. 8 and an accessory sleeve.

FIGS. 8 and 9 depict an alternative embodiment of a slidable mass for use inside a bat of the invention and an accessory sleeve. The generally cylindrical sleeve 40, which may be made of any rigid material such as metal but preferably is made of resilient material like urethane, can be added to the bat interior such that it is nested within the interior surface 30 of barrel portion 22. The sleeve provides an additional channel in which the slidable mass is contained such that any dents or other damage to the barrel portion 22 do not interfere with the sliding motion of the mass.

The sleeve 40 may include a hole 42 such that air may be released form the sleeve as a slideable mass 44 moves towards the hole. In this embodiment of the slidable mass, a passage 50 exists through the mass 44 to allow air transfer during movement of the mass and a weight 46 is removably attached within threaded portion 48. The weight 46 is removable to facilitate the use of different weights according to the preference of a user.

FIG. 9 depicts a cross-sectional view of a bat utilizing a sleeve and the slidable mass of FIG. 8. Because of the tapered conical shape and length of weight 46, it protrudes into the taper portion 26 of the bat and may even reach the end of the handle portion 28, depending on the bat. Thus, a user experiences an improved swing motion as the slidable mass 44 and attached weight 46 travel almost the length of the bat from the handle to the end cap 24.

While the bat 20 and sleeve 40 can be designed such that the end cap 24 and the handle portion 28 stop the motion of the slidable mass 44 such that it is contained within the sleeve 40, the sleeve may also include end fittings 52 (e.g. a plug) and 54 (e.g. a grommet) that fit in an opening and around the circumference of the sleeve 40 such that the slidable mass 44 is contained inside and the sleeve is positioned with a space between the sleeve and interior surface 30 of the bat. The end fittings may be additional components or may be formed with the sleeve to be of one-piece construction.

In addition, a kit is provided comprising a bat with a hollow interior and removable end cap, a cylindrical sleeve that fits in nested arrangement within the hollow interior, and a slidable mass configured to slide within the sleeve. An assortment of detachable weights, end fittings, and other accessories may further be included.

Figure 11:
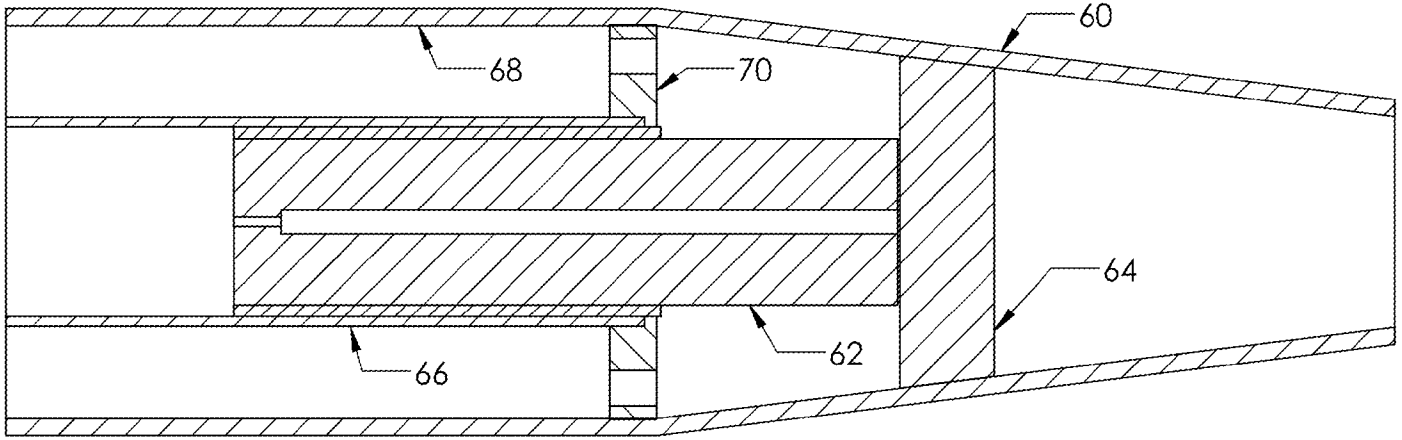
FIG. 11 depicts section A-A of FIG. 10.
Figure 10:
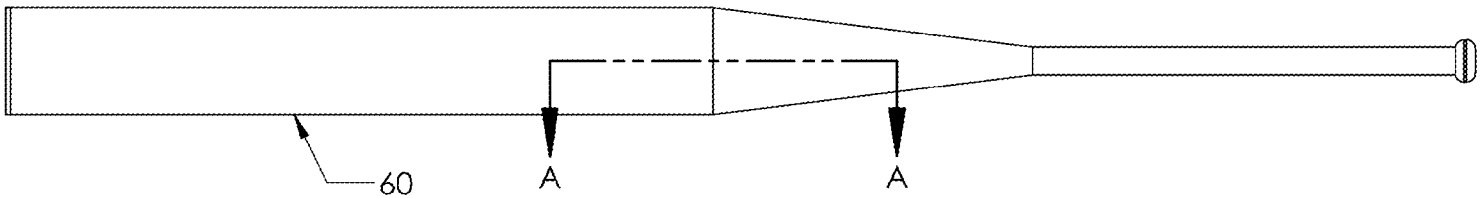
FIG. 10 depicts a bat embodiment.
Figure 14:
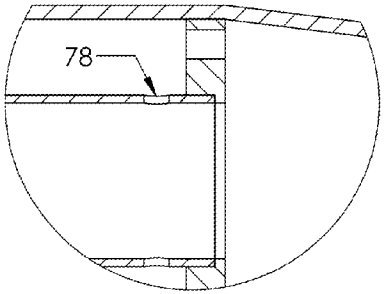
FIG. 14 depicts detail B of FIG. 13.
Figure 13:
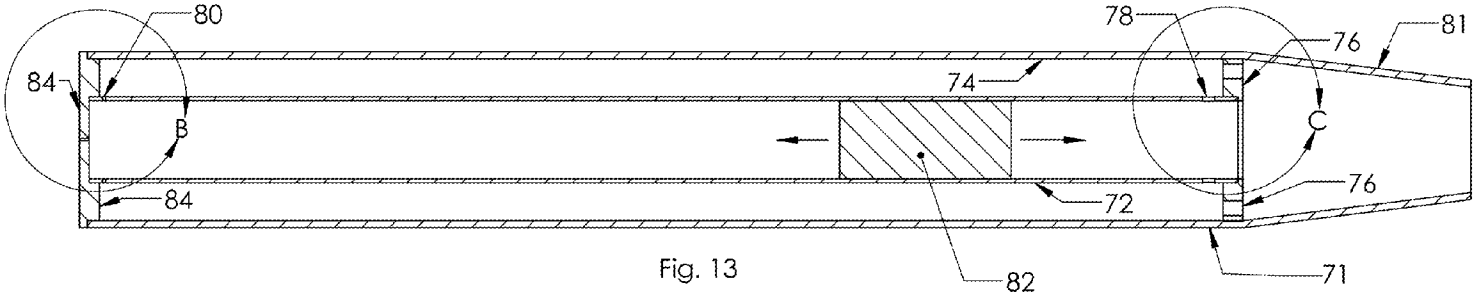
FIG. 13 depicts section A-A of FIG. 12.
Figure 12:
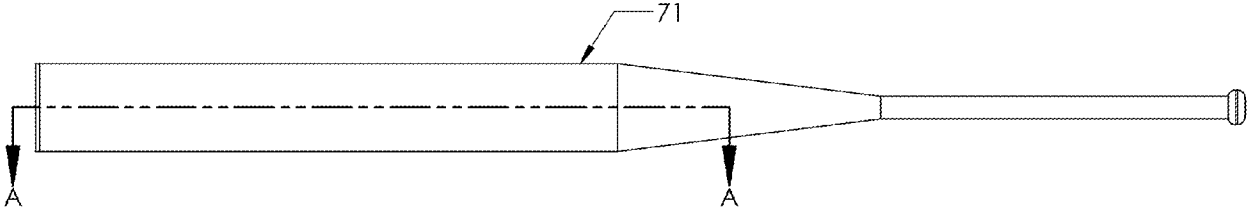
FIG. 12 depicts a handle and neck portion of a training device.
Figure 15:
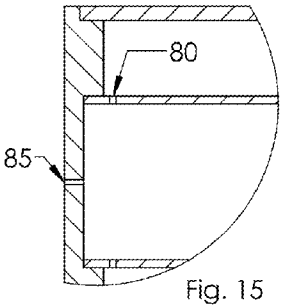
FIG. 15 depicts detail C of FIG. 13.

Turning to FIGS. 10 and 11, a sports or exercise training device 60 (which may be embodied in a implement that is swung with one or both hands, such as a bat, racquet, or golf club) is depicted that includes a hollow body defining a interior volume and a slidable mass 62. In this embodiment, the hollow body includes a magnet 64 disposed at a handle end (shown as the tapering end of device 60) and the slidable mass 62 includes at least a magnetic portion configured to seat the slidable mass 62 through magnetic attraction to the magnet 64. To unseat the slidable mass 62 from the magnet 64, a user applies a swinging force.

The slidable mass 62 is contained and slides within a generally cylindrical sleeve 66 having a first end and a second end. Generally cylindrical is defined to include polygonal and other shapes that approximate a cylinder (for example, an octagon sleeve). The generally cylindrical sleeve 66 is in nested arrangement with an interior circumference 68 of the hollow body and is held in the nested arrangement by, for example, a plurality of struts 70.

As seen in FIGS. 12-15, training device 71 features a hollow interior volume with a sleeve 72 that is disposed in nested arrangement with an interior surface 74 by struts 76. The sleeve 72 further includes a pair of openings (78 and 80) disposed proximally to each end of the sleeve. Preferably, the larger opening located proximal to the handle end 81 of the device 71 to allow the slidable mass 82 inside the sleeve to return to the handle end more rapidly. Alternatively, the pair of openings may be in a bat end (e.g., opening 85 in end cap 84) and in an opposite end of the sleeve (e.g., opening 78).

Due to the struts 76, the slidable mass 82 is free from contact with any structure within the hollow body except an inner surface of the generally cylindrical sleeve and an end cap 84 of the device (or end fitting of the sleeve).

Figure 17:
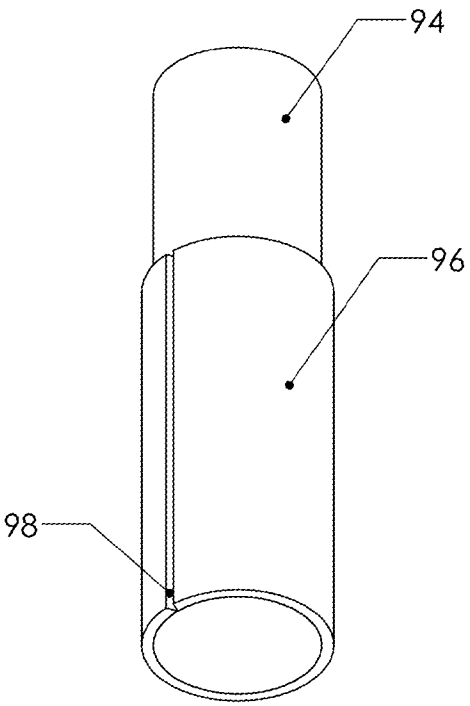
FIG. 17 depicts another slidable mass embodiment.
Figure 16:
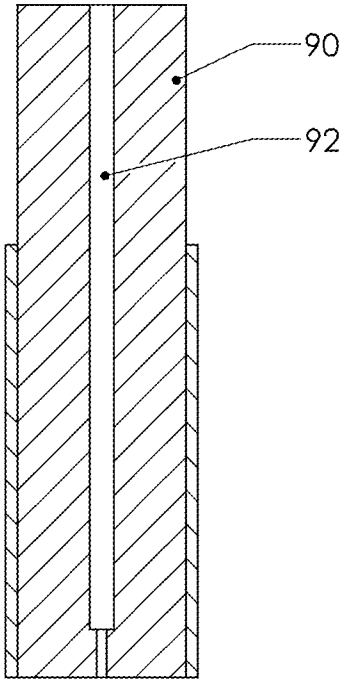
FIG. 16 depicts a slidable mass.

Moreover, as seen in FIGS. 16 and 17, a slidable mass 90 may include a longitudinal passage 92 with a different diameter opening at each end, or a slidable mass 94 may have a passage in a outer layer 96 forming a slit or notch 98 that allows for air displacement when mass 94 is sliding. Alternatively, the notch 98 could be included in the circumference of the sliding mass 94 and not in an added outer layer.

Various changes in the details and components that have been described may be made by those skilled in the art within the principles and scope of the invention herein described in the specification and defined in the appended claims. Therefore, while the present invention has been shown and described herein in what is believed to be the most practical and preferred embodiments, it is recognized that departures can be made therefrom within the scope of the invention, which is not to be limited to the details disclosed herein but is to be accorded the full scope of the claims so as to embrace any and all equivalent processes and products.

What is claimed is:

1. A sports or exercise training device configured to be swung by one or both hands of a user, comprising:

a hollow body defining a interior volume; and a slidable mass, wherein the slidable mass is contained and slides within a generally cylindrical sleeve having a first end and a second end and the generally cylindrical sleeve is in nested arrangement with an interior circumference of said hollow body, and wherein said sleeve includes at least a pair of openings disposed proximally to each sleeve end or in a device end and an opposite end of said sleeve, and wherein one of said at least a pair of openings is larger than the other.

2. The training device of claim 1, wherein said generally cylindrical sleeve is held in nested arrangement by a plurality of struts.

3. The training device of claim 1, wherein said slidable mass is free from contact with any structure within said hollow body except an inner surface of said generally cylindrical sleeve and an end cap of the device or end fitting of the sleeve.

4. The training device of claim 1, wherein a magnet is disposed at a handle end and the slidable mass includes at least a magnetic portion configured to seat the slidable mass through magnetic attraction to the magnet.

5. A sports or exercise training device configured to be swung by one or both hands of a user, comprising:

a hollow body defining a interior volume within said training device; and a slidable mass having a passage that extends through the mass in the direction of movement, wherein the slidable mass is contained within said interior volume and, wherein said passage that extends through the mass has a different diameter at each end of said mass.

6. The training device of claim 5, wherein said hollow body includes a magnet disposed at a handle end of said device and said slidable mass includes at least a magnetic portion configured to seat the slidable mass through magnetic attraction to said magnet and to unseat the slidable mass from said magnet upon the application of a swinging force by said user.

7. The training device of claim 5, wherein said slidable mass is free from contact with any structure within said hollow body except an inner surface of said interior volume and an end cap of the device.

* * * * *